US011741915B2

(12) United States Patent
Shiibayashi et al.

(10) Patent No.: US 11,741,915 B2
(45) **Date of Patent: *Aug. 29, 2023**

(54) DISPLAY DRIVER SUPPRESSING COLOR UNEVENNESS OF LIQUID CRYSTAL DISPLAY

(71) Applicant: LAPIS Semiconductor Co., Ltd., Yokohama (JP)

(72) Inventors: Kenichi Shiibayashi, Yokohama (JP); Keigo Otani, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/828,032

(22) Filed: May 31, 2022

(65) Prior Publication Data

US 2022/0293063 A1 Sep. 15, 2022

Related U.S. Application Data

(63) Continuation of application No. 17/110,309, filed on Dec. 3, 2020, now Pat. No. 11,373,616.

(30) Foreign Application Priority Data

Dec. 6, 2019 (JP) ..... 2019-221012

(51) Int. Cl.
*G09G 3/36* (2006.01)

(52) U.S. Cl.
CPC ..... *G09G 3/3688* (2013.01); *G09G 3/3696* (2013.01); *G09G 2310/027* (2013.01);
(Continued)

(58) Field of Classification Search
CPC ..... G09G 3/36; G09G 3/3611; G09G 3/3614; G09G 3/3622; G09G 3/3625; G09G 3/364;
(Continued)

(56) References Cited

U.S. PATENT DOCUMENTS 6,535,189 B1 * 3/2003 Akiyama ..... G09G 3/2011 345/87
9,767,761 B2 * 9/2017 Shiibayashi ..... G09G 3/3688
(Continued)

FOREIGN PATENT DOCUMENTS

CN 1979628 6/2007
CN 101248481 8/2008
(Continued)

OTHER PUBLICATIONS

"Office Action of China Counterpart Application", dated Dec. 28, 2022, with English translation thereof, p. 1-p. 15.
(Continued)

*Primary Examiner* — Amit Chatly
*Assistant Examiner* — Nelson Lam
(74) *Attorney, Agent, or Firm* — JCIPRNET

(57) ABSTRACT

The disclosure includes bus wiring constituted by wiring lines; a gradation voltage generation circuit that generates M gradation voltages representing brightness levels with M gradations, and applies the M gradation voltages to an intermediate portion on M wiring lines belonging to the bus wiring; a plurality of decoders, each of which receives M gradation voltages via the M wiring lines and selects one of the M gradation voltages according to the pixel data pieces to output the selected gradation voltage; a plurality of output amplifiers that individually amplifies the voltages output from the plurality of decoders and generates the amplified voltages as the plurality of pixel drive voltages; and first and second inter-gradation short circuits that short-circuit one ends of each of the M wiring lines and the other ends of each of the M wiring lines according to a load signal for capturing the pixel data pieces.

7 Claims, 9 Drawing Sheets

(52) U.S. Cl.
CPC ..... *G09G 2310/0291* (2013.01); *G09G 2320/0242* (2013.01)

(58) Field of Classification Search
CPC .. G09G 3/3688; G09G 3/3692; G09G 3/3696; G09G 2310/027; G09G 2310/0291
USPC ..... 345/87–104
See application file for complete search history.

(56) References Cited

U.S. PATENT DOCUMENTS

| | | | | |
|---|---|---|---|---|
| 10,446,109 | B2 * | 10/2019 | Shiibayashi | G09G 3/3696 |
| 10,650,771 | B2 * | 5/2020 | Shiibayashi | H03F 3/45179 |
| 11,373,616 | B2 * | 6/2022 | Shiibayashi | G09G 3/3688 |
| 2008/0122820 | A1 * | 5/2008 | Umeda | G09G 3/3648 345/205 |
| 2011/0316821 | A1 * | 12/2011 | Suzuki | G09G 3/3688 345/204 |
| 2012/0062544 | A1 * | 3/2012 | Satani | G09G 3/3614 345/212 |
| 2015/0124006 | A1 * | 5/2015 | Ura | G09G 3/3696 345/77 |
| 2015/0221276 | A1 * | 8/2015 | Ishii | G09G 3/3685 345/98 |
| 2015/0339989 | A1 * | 11/2015 | Hasegawa | G09G 3/3674 345/694 |
| 2016/0055785 | A1 * | 2/2016 | Kondo | G09G 3/20 345/88 |
| 2016/0071479 | A1 * | 3/2016 | Shiibayashi | G09G 3/3688 345/212 |
| 2017/0110067 | A1 * | 4/2017 | Shiibayashi | G09G 3/3614 |
| 2017/0148410 | A1 * | 5/2017 | Shiibayashi | G09G 3/3688 |
| 2017/0263185 | A1 * | 9/2017 | Nakagawa | H01L 51/50 |
| 2018/0061359 | A1 * | 3/2018 | Shiibayashi | G09G 3/3696 |
| 2019/0012980 | A1 * | 1/2019 | Shiibayashi | G09G 3/3696 |
| 2019/0206358 | A1 * | 7/2019 | Nagasaka | G09G 3/3688 |
| 2021/0012731 | A1 * | 1/2021 | Shiibayashi | G09G 3/3696 |

FOREIGN PATENT DOCUMENTS

| | | |
|---|---|---|
| CN | 107799078 | 3/2018 |
| JP | H09138670 | 5/1997 |
| JP | 2008026510 | 2/2008 |
| JP | 2008129386 | 6/2008 |
| JP | 2011150256 | 8/2011 |
| JP | 2017090873 | 5/2017 |
| KR | 20120072944 | 7/2012 |

OTHER PUBLICATIONS

"Office Action of Japan Counterpart Application", dated Apr. 18, 2023, with English translation thereof, p. 1-p. 6.

* cited by examiner

DISPLAY DRIVER SUPPRESSING COLOR UNEVENNESS OF LIQUID CRYSTAL DISPLAY

CROSS-REFERENCE TO RELATED APPLICATION

This application is a continuation application of and claims priority benefit of a prior application Ser. No. 17/110,309, filed on Dec. 3, 2020, now pending. The prior application Ser. No. 17/110,309 claims the priority benefit of Japanese Patent Application No. 2019-221012, filed on Dec. 6, 2019. The entirety of each of the above-mentioned patent applications is hereby incorporated by reference herein and made a part of this specification.

BACKGROUND

Technical Field

The disclosure relates to a display driver that drives a display panel according to a video signal and a display device that includes the display driver.

Description of Related Art

A liquid crystal display device includes a liquid crystal panel, a gate driver that drives a plurality of scanning lines formed on the liquid crystal panel, and a source driver that drives a plurality of signal lines intersecting each scanning line in the liquid crystal panel.

As the source driver, a source driver that includes a resistor voltage-dividing circuit, a gradation amplifier, a plurality of digital-to-analog converter (DAC) circuits, and a plurality of output terminals which is external terminals is known (see Patent Document 1, for example).

The resistor voltage-dividing circuit and the gradation amplifier (referred to as a gradation voltage generation circuit) generate 64 voltages corresponding to the brightness of 64 gradations by dividing the power supply voltage, and the voltages are supplied, as 64 gradation signals, to each of the DAC circuits via gradation signal bus wiring. Each DAC circuit selects one signal corresponding to a display data, from the 64 gradation signals received via the gradation signal bus wiring, and outputs the signal via the output terminal corresponding to the DAC circuit. Each DAC circuit is disposed in the source driver at a position corresponding to one of the output terminals disposed side by side in a row.

PATENT DOCUMENTS

[Patent Document 1] Japanese Patent Laid-Open No. 2009-69287

Incidentally, in such a source driver, the level of each gradation signal may temporarily decrease (or increase) due to load fluctuation associated with a change in display data for each horizontal scanning period, and then gradually increase (or decrease) to return to each desired level.

In this case, from the time when the level of the gradation signal decreases (or increases) to the time when the level thereof returns to the desired level, there is a delay due to the wiring resistance corresponding to the wiring length between the gradation voltage generation circuit and the DAC circuit, and the input capacitance of a final stage output amplifier included in the DAC circuit. Accordingly, in the output signal of the DAC circuit disposed at a position far from the gradation voltage generation circuit (referred to as a far end DAC), a large delay occurs compared to the output signal of the DAC circuit disposed at a position near the gradation voltage generation circuit (referred to as a near end DAC).

Therefore, when one horizontal scanning period is shortened due to the recent increases in screen size and high definition of display devices, at the end of each horizontal scanning period, the level on the signal line in the liquid crystal panel that has received the output signal from the near end DAC reaches the desired level, but the level on the signal line in the liquid crystal panel that has received the output signal from the far end DAC may not reach the desired level. Accordingly, there is a level difference between the signal level on the signal line which is responsible for displaying a screen center region of the liquid crystal panel and the signal level on the signal line which is responsible for displaying screen left and right end regions of the liquid crystal panel. Therefore, in a case in which the level difference is one gradation or more, there is a possibility that color unevenness may be visible between the screen center region and the screen left and right end regions.

SUMMARY

According to an embodiment of the disclosure, there is provided a display driver that captures a plurality of pixel data pieces based on a video signal and according to a load signal and generates a plurality of pixel drive voltages to be applied to a plurality of source lines of a display panel according to the plurality of captured pixel data pieces, the display driver including: bus wiring constituted by a plurality of wiring lines; a gradation voltage generation circuit that generates M gradation voltages representing brightness levels with M gradations (M is an integer of 2 or more), and applies the M gradation voltages to an intermediate portion between one end and the other end of each of M wiring lines belonging to the bus wiring; a plurality of decoders which is disposed side by side along the M wiring lines, and each of which receives the M gradation voltages via the M wiring lines and selects one of the M gradation voltages according to the pixel data pieces to output the selected gradation voltage; a plurality of output amplifiers that individually amplifies the voltages output from the plurality of decoders and generates the amplified voltages as the plurality of pixel drive voltages; a first inter-gradation short circuit that short-circuits one ends of each of the M wiring lines according to the load signal; and a second inter-gradation short circuit that short-circuits the other ends of each of the M wiring lines according to the load signal.

According to another embodiment of the disclosure, there is provided a display driver that captures a plurality of pixel data pieces based on a video signal and according to a load signal and generates a plurality of pixel drive voltages to be applied to a plurality of source lines of a display panel according to the plurality of captured pixel data pieces, the display driver including: first and second bus wiring each constituted by a plurality of wiring lines; a gradation voltage generation circuit that generates M gradation voltages representing brightness levels with M gradations (M is an integer of 2 or more), applies the M gradation voltages to an intermediate portion between one end and the other end of each of M wiring lines belonging to the first bus wiring, and applies the M gradation voltages to an intermediate portion between one end and the other end of each of M wiring lines belonging to the second bus wiring; first to rth decoders (r is an integer of 2 or more) which are disposed side by side along the first bus wiring, and each of which receives the M gradation voltages via the M wiring lines belonging to the first bus wiring and selects one of the M gradation voltages according to the pixel data pieces to output the selected gradation voltage; (r+1)th to nth decoders which are disposed side by side along the second bus wiring, and each of which receives the M gradation voltages via the M wiring lines belonging to the second bus wiring and selects one of the M gradation voltages according to the pixel data pieces to output the selected gradation voltage; output amplifiers that individually amplify the voltages output from the first to rth decoders and the (r+1)th to nth decoders and generate the amplified voltages as n pixel drive voltages; a first inter-gradation short circuit that short-circuits one ends of each of the M wiring lines belonging to the first bus wiring according to the load signal; a second inter-gradation short circuit that short-circuits the other ends of each of the M wiring lines belonging to the first bus wiring according to the load signal; a third inter-gradation short circuit that short-circuits one ends of each of the M wiring lines belonging to the second bus wiring according to the load signal; and a fourth inter-gradation short circuit that short-circuits the other ends of each of the M wiring lines belonging to the second bus wiring according to the load signal.

According to still another embodiment of the disclosure, there is provided a display driver that captures a plurality of pixel data pieces based on a video signal and according to a load signal and generates a plurality of pixel drive voltages to be applied to a plurality of source lines of a display panel according to the plurality of captured pixel data pieces, the display driver comprising: bus wiring constituted by M wiring lines (M is an integer of 2 or more); a gradation voltage generation circuit that generates M gradation voltages representing brightness levels with gradations, and applies the M gradation voltages to a portion between one end and the other end of each of the M wiring lines; a plurality of decoders which is disposed side by side along the M wiring lines, and each of which receives the M gradation voltages via the M wiring lines and selects one of the M gradation voltages according to the pixel data pieces to output the selected gradation voltage; a plurality of output amplifiers that individually amplifies the voltages output from the plurality of decoders and generates the amplified voltages as the plurality of pixel drive voltages; and an inter-gradation short circuit that short-circuits at least one of the one ends and the other ends of each of the M wiring lines according to the load signal.

According to still another embodiment of the disclosure, there is provided a display device which includes a display panel that has a plurality of source lines, and a display driver that captures a plurality of pixel data pieces based on a video signal and according to a load signal and generates a plurality of pixel drive voltages according to the plurality of captured pixel data pieces to apply each pixel drive voltage to the plurality of source lines of the display panel, wherein the display driver includes bus wiring constituted by a plurality of wiring lines; a gradation voltage generation circuit that generates M gradation voltages representing brightness levels with M gradations (M is an integer of 2 or more), and applies the M gradation voltages to an intermediate portion between one end and the other end of each of M wiring lines belonging to the bus wiring; a plurality of decoders which is disposed side by side along the M wiring lines, and each of which receives the M gradation voltages via the M wiring lines and selects one of the M gradation voltages according to the pixel data pieces to output the selected gradation voltage; a plurality of output amplifiers that individually amplifies the voltages output from the plurality of decoders and generates the amplified voltages as the plurality of pixel drive voltages; a first inter-gradation short circuit that short-circuits one ends of each of the M wiring lines according to the load signal; and a second inter-gradation short circuit that short-circuits the other ends of each of the M wiring lines according to the load signal.

According to still another embodiment of the disclosure, there is provided a display device which includes a display panel that has a plurality of source lines, and a display driver that captures a plurality of pixel data pieces based on a video signal and according to a load signal and generates a plurality of pixel drive voltages according to the plurality of captured pixel data pieces to apply each pixel drive voltage to the plurality of source lines of the display panel, wherein the display driver includes first and second bus wiring each constituted by a plurality of wiring lines; a gradation voltage generation circuit that generates M gradation voltages representing brightness levels with M gradations (M is an integer of 2 or more), applies the M gradation voltages to an intermediate portion between one end and the other end of each of M wiring lines belonging to the first bus wiring, and applies the M gradation voltages to an intermediate portion between one end and the other end of each of M wiring lines belonging to the second bus wiring; first to rth decoders (r is an integer of 2 or more) which are disposed side by side along the first bus wiring, and each of which receives the M gradation voltages via the M wiring lines belonging to the first bus wiring and selects one of the M gradation voltages according to the pixel data pieces to output the selected gradation voltage; (r+1)th to nth decoders which are disposed side by side along the second bus wiring, and each of which receives the M gradation voltages via the M wiring lines belonging to the second bus wiring and selects one of the M gradation voltages according to the pixel data pieces to output the selected gradation voltage; output amplifiers that individually amplify the voltages output from the first to rth decoders and the (r+1)th to nth decoders and generate the amplified voltages as n pixel drive voltages; a first inter-gradation short circuit that short-circuits one ends of each of the M wiring lines belonging to the first bus wiring according to the load signal; a second inter-gradation short circuit that short-circuits the other ends of each of the M wiring lines belonging to the first bus wiring according to the load signal; a third inter-gradation short circuit that short-circuits one ends of each of the M wiring lines belonging to the second bus wiring according to the load signal; and a fourth inter-gradation short circuit that short-circuits the other ends of each of the M wiring lines belonging to the second bus wiring according to the load signal.

DESCRIPTION OF THE EMBODIMENTS

The disclosure provides a display driver and a display device capable of displaying a high-quality and high-definition image in which such color unevenness is suppressed.

The display driver according to the disclosure includes a gradation voltage generation circuit that generates M gradation voltages representing brightness levels with M gradations (M is an integer of 2 or more), and applies the M gradation voltages to an intermediate portion of each of M wiring lines; and a plurality of decoders which is disposed side by side along the M wiring lines, and each of which selects one of the M gradation voltages received via the M wiring lines according to the pixel data pieces to output the selected gradation voltage.

Here, in the display driver, one ends of each of the M wiring lines are short-circuited and the other ends of each of the M wiring lines are short-circuited according to a load signal for capturing a plurality of pixel data pieces.

By such a short-circuit process, the delay time in the decoder disposed at a position where the wiring length from the gradation voltage generation circuit is long, that is, the decoder which is responsible for displaying the screen left and right end regions is shortened. Therefore, the difference between the delay time of the decoder disposed at a position where the wiring length is short, that is, the decoder which is responsible for displaying the screen center region, and the delay time of the decoder which is responsible for displaying the screen left and right end regions becomes small.

Accordingly, at the end of the horizontal scanning period, the difference between the voltage of the source line which is responsible for displaying the screen center region of the display panel and the voltage of the source line which is responsible for displaying the screen left and right end regions can be reduced to less than the voltage for one gradation.

Therefore, according to the disclosure, it is possible to provide a high-quality display image in which the color unevenness is suppressed.

Hereinafter, embodiments of the disclosure will be described in detail with reference to the drawings.

Figure 1:
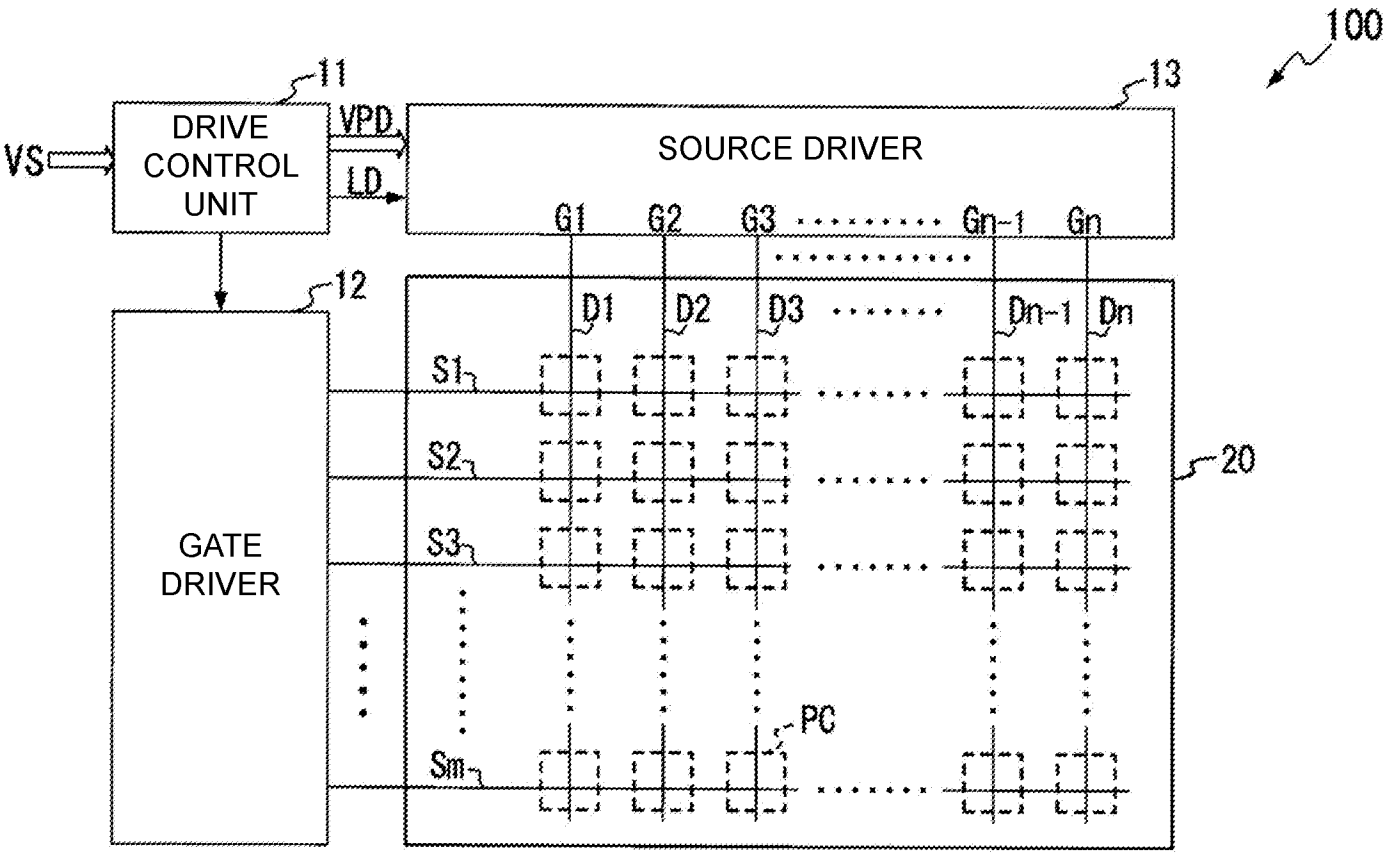
FIG. 1 is a block diagram showing a configuration of a display device 100 including a source driver 13 according to the disclosure.

FIG. 1 is a block diagram showing a configuration of a display device 100 including a display driver according to the disclosure. As shown in FIG. 1, the display device 100 includes a drive control unit 11, a gate driver 12, a source driver 13, and a display panel 20 including, for example, a liquid crystal panel.

The display panel 20 has m horizontal scanning lines Si to Sm (m is an integer of 2 or more) each extending in a horizontal direction of a two-dimensional screen and n source lines D1 to Dn (n is an integer of 2 or more) each extending in a vertical direction of the two-dimensional screen. Further, a display cell PC carrying pixels is formed in a region at each intersection of the horizontal scanning lines S and the source lines D (a region surrounded by a broken line).

The drive control unit 11 receives an input video signal VS, generates a horizontal synchronization signal based on the input video signal VS, and supplies the horizontal synchronization signal to the gate driver 12. Further, the drive control unit 11 generates a video data signal VPD including a series of pixel data PD representing the brightness level of the pixel as 6-bit data for each pixel, for example, based on the input video signal VS, and supplies the series of pixel data PD to a source driver 13. Further, the drive control unit 11 generates a binary load signal LD corresponding to the horizontal synchronization signal and supplies the load signal to the source driver 13.

Figure 2:
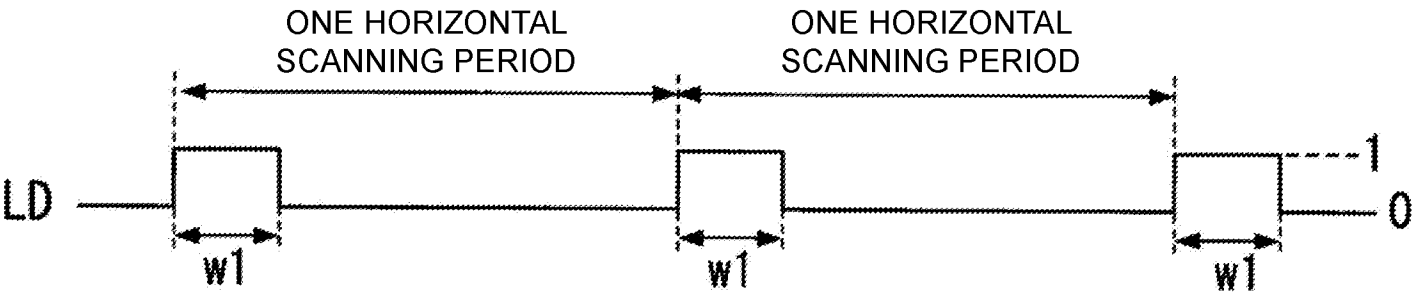
FIG. 2 is a waveform diagram showing a load signal LD.

FIG. 2 is a time chart showing an example of the load signal LD.

As shown in FIG. 2, the drive control unit 11 generates, as the load signal LD, a pulse signal that transitions, for example, from a state of a logic level 0 to a logic level 1 in the beginning of each horizontal scanning period and maintains a state of the logic level 1 for each predetermined period w1.

The gate driver 12 generates a gate pulse in synchronization with the horizontal synchronization signal supplied from the drive control unit 11, and applies the gate pulse to each of the horizontal scanning lines Si to Sm of the display panel 20 in order.

The source driver 13 generates pixel drive signals G1 to Gn corresponding to the source lines D1 to Dn of the display panel 20 based on the video data signal VPD, and individually supplies the pixel drive signals G1 to Gn to the corresponding source lines D1 to Dn. The source driver 13 is formed in a single semiconductor chip or a plurality of divided semiconductor chips.

Figure 3:
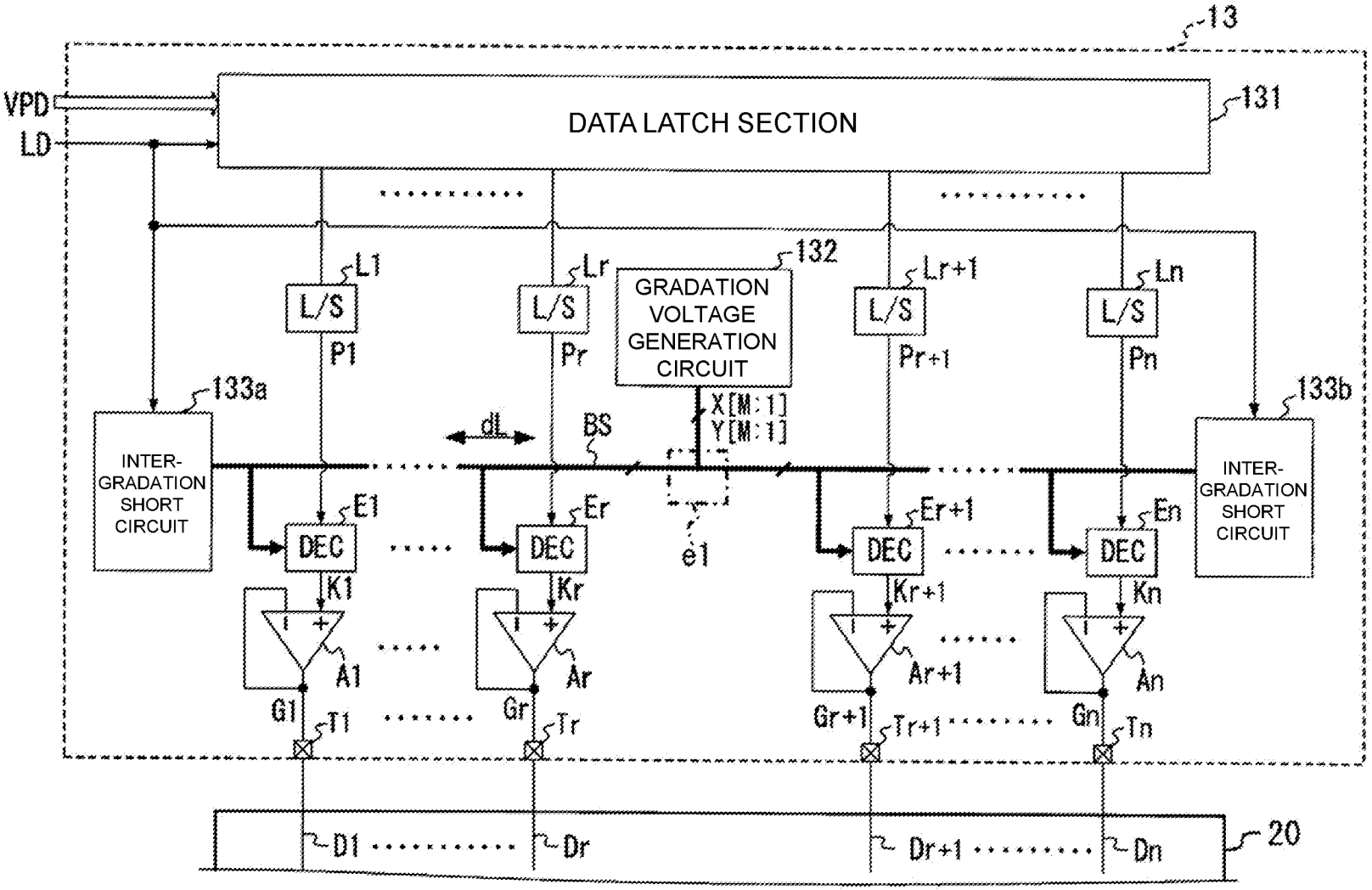
FIG. 3 is a circuit diagram showing an internal configuration of the source driver 13.

FIG. 3 is a block diagram showing an internal configuration of the source driver 13.

As shown in FIG. 3, the source driver 13 includes a data latch section 131, a gradation voltage generation circuit 132, inter-gradation short circuits 133*a* and 133*b*, decoders E1 to En, and output amplifiers A1 to An.

The data latch section 131 captures a series of pixel data PD included in the video data signal VPD for one horizontal scanning line, that is, n pieces at a time according to the load signal LD. Then, the data latch section 131 supplies the captured n pieces of pixel data PD to level shift circuits L1 to Ln.

The level shift circuits L1 to Ln supply n pixel data pieces obtained by level-shifting the amplitude of the signal level of each of n pieces of pixel data PD to a level at which the pixel data can be used by the decoders E1 to En, as pixel data P1 to Pn, to the decoders E1 to En, respectively.

The gradation voltage generation circuit 132 generates M gradation voltages Y[1] to Y[M] (M is an integer of 2 or more) each having a positive voltage value according to an inverse gamma characteristic with respect to a gamma characteristic of the display panel 20. Further, the gradation voltage generation circuit 132 generates M gradation voltages X[1] to X[M] each having a negative voltage value according to the above-described inverse gamma characteristic. Hereinafter, the gradation voltages Y[1] to Y[M] are also represented as gradation voltages Y[M:1], and the gradation voltages X[1] to X[M] are also represented as gradation voltages X[M:1].

Figure 4:
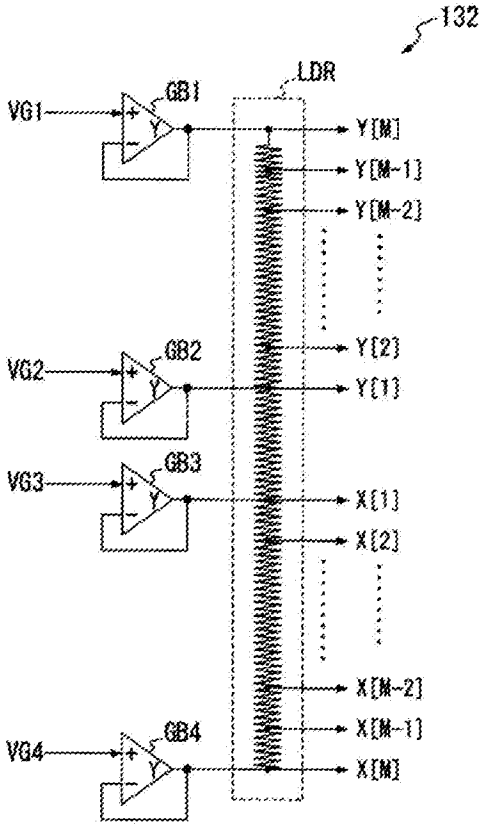
FIG. 4 is a circuit diagram showing a configuration of an output stage of a gradation voltage generation circuit 132.

FIG. 4 is a circuit diagram showing a configuration of an output stage of the gradation voltage generation circuit 132.

As shown in FIG. 4, the gradation voltage generation circuit 132 includes gamma buffers GB1 to GB4 and a ladder resistor LDR.

Each of the gamma buffers GB1 to GB4 is constituted by, for example, a so-called voltage follower circuit which is constituted by an operational amplifier and in which an inverting input terminal (−) is connected to an output terminal Y, as shown in FIG. 4. The gamma buffers GB1 to GB4 individually receive reference voltages VG1 to VG4 having the following magnitude relations and voltage values according to the above-described inverse gamma characteristic at their respective non-inverting input terminals (+).

VG1>VG2>VG3>VG4

As shown in FIG. 4, the output terminals Y of the gamma buffers GB1 to GB4 are connected to four different connection points of the ladder resistor LDR. With this configuration, the ladder resistor LDR generates M voltages obtained by dividing a section between the reference voltages VG1 and VG2 into M sections according to the above-described inverse gamma characteristic, as the positive gradation voltages Y[M:1]. Further, the ladder resistor LDR generates M voltages obtained by dividing a section between the reference voltages VG4 and VG3 into M sections according to the above-described inverse gamma characteristic, as the negative gradation voltages X[M:1].

The gradation voltage generation circuit 132 supplies the above-described M positive gradation voltages Y[M:1] and M negative gradation voltages X[M:1] to each of the decoders E1 to En via bus wiring BS constituted by 2M wiring lines.

Each of the decoders E1 to En alternately selects the positive gradation voltages Y[M:1] and the negative gradation voltages X[M:1] for each predetermined period. Here, each of the decoders E1 to En selects, from the selected M gradation voltages, at least one gradation voltage corresponding to the brightness level indicated by the pixel data P that each of the decoders has received. The decoders E1 to En supply gradation signals K1 to Kn having the gradation voltage selected by each of the decoders to the output amplifiers A1 to An.

Each of the output amplifiers A1 to An is, for example, a so-called voltage follower circuit in which an output terminal is connected to an inverting input terminal (—) and which is constituted by an operational amplifier. The output amplifiers A1 to An receive the gradation signals K1 to Kn output from the decoders E1 to En at their respective non-inverting input terminals (+), and output the currents according to the received gradation signals to the output terminals of the output amplifiers, so that the output amplifiers generate pixel drive signals G1 to Gn corresponding to the gradation voltages. The pixel drive signals G1 to Gn are output via external terminals T1 to Tn of the semiconductor chip in which the source driver 13 is formed, and are supplied to the source lines D1 to Dn of the display panel 20.

Incidentally, an example of the disposition form in the semiconductor chip of the decoders E1 to En, the output amplifiers A1 to An, the external terminals T1 to Tn, the bus wiring BS, the gradation voltage generation circuit 132, and the inter-gradation short circuit circuits 133*a* and 133*b* is shown in the circuit diagram shown in FIG. 3.

That is, in the semiconductor chip, as shown in FIG. 3, the decoders E1 to En and the output amplifiers A1 to An are disposed side by side along the bus wiring BS constituted by 2M wiring lines extending in a direction dL.

As shown in FIG. 3, the gradation voltage generation circuit 132 applies the gradation voltages Y[M:1] and X[M:1] to an intermediate portion on the bus wiring BS extending in the direction dL, that is, an intermediate portion el between one end and the other end of each of the 2M wiring lines belonging to the bus wiring BS. Further, as shown in FIG. 3, it is desirable to position the intermediate portion el on the bus wiring BS in a region interposed between Er and Er+1 disposed in the center of the decoders E1 to En.

Figure 5:
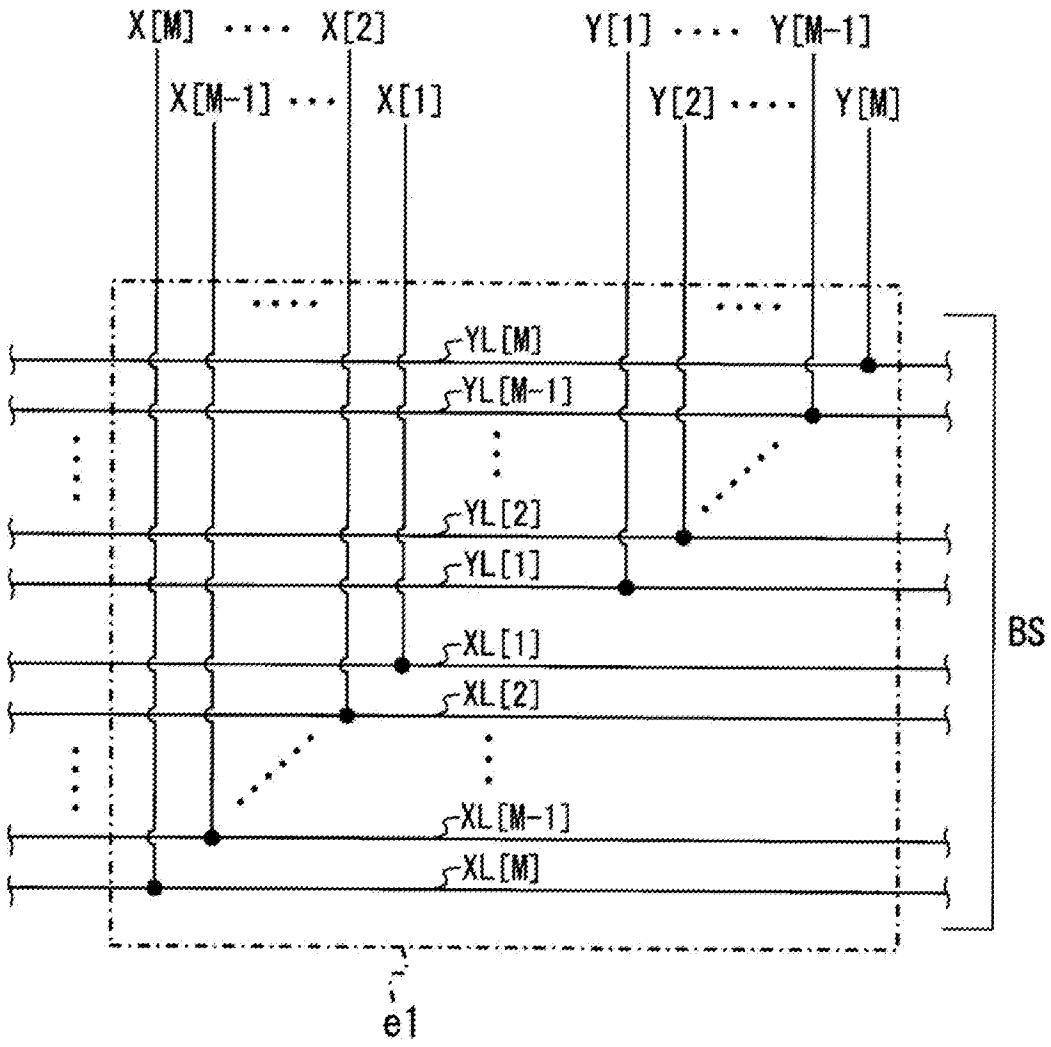
FIG. 5 is a diagram showing an example of a connection form at an intermediate portion el of bus wiring BS.

FIG. 5 is a diagram showing in detail a connection form at the bus wiring BS and the intermediate portion el.

As shown in FIG. 5, the bus wiring BS is constituted by wiring lines YL[1] to YL[M] for transmitting the gradation voltages Y[1] to Y[M] to each of the decoders E1 to En, and wiring lines XL[1] to XL[M] for transmitting the gradation voltages X[1] to X[M] to each of the decoders E1 to En. That is, the gradation voltage generation circuit 132 applies the positive gradation voltages Y[1] to Y[M] that it generates to the wiring lines YL[1] to YL[M] included in the bus wiring BS at the intermediate portion el, respectively. Further, the gradation voltage generation circuit 132 applies the negative gradation voltages X[1] to X[M] generated by itself to the wiring lines XL[1] to XL[M] included in the bus wiring BS at the intermediate portion el, respectively.

Further, as shown in FIG. 3, each of the decoders E1 to En receives the positive gradation voltages Y[M:1] and the negative gradation voltages X[M:1] via the 2M wiring lines branched from the bus wiring BS at positions corresponding to thereto.

Further, as shown in FIG. 3, the inter-gradation short circuit 133*a* is formed at one end of the bus wiring BS, and the inter-gradation short circuit 133*b* is formed at the other end of the bus wiring BS.

Figure 6:
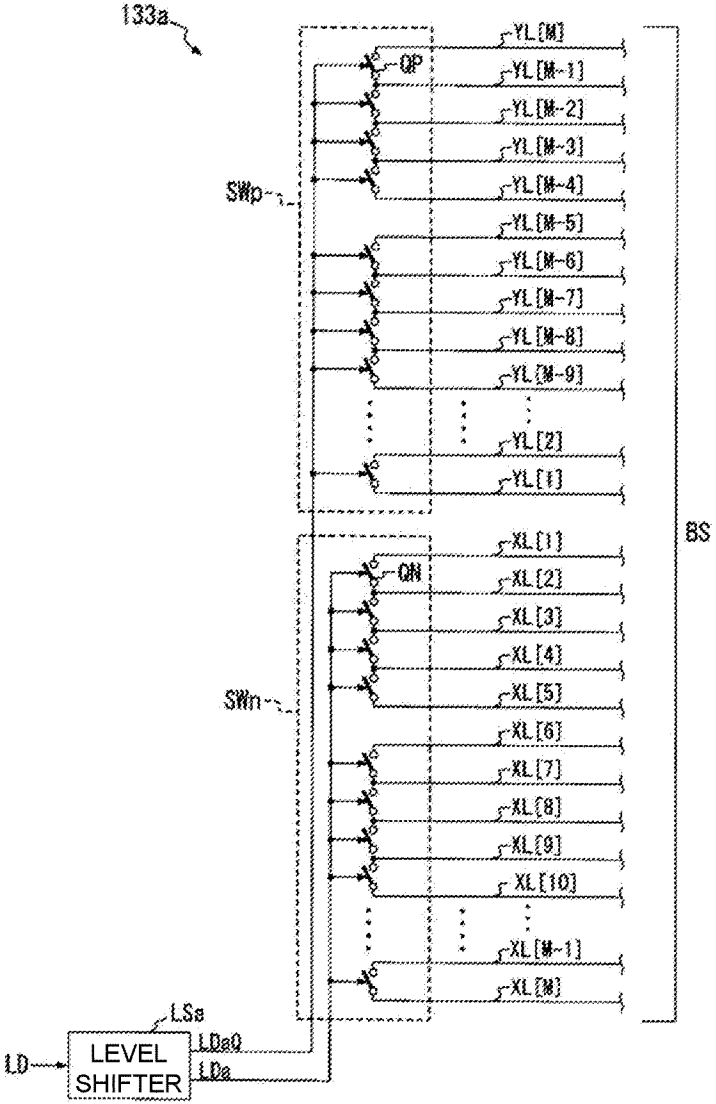
FIG. 6 is a circuit diagram showing an inter-gradation short circuit 133*a*.

FIG. 6 is a circuit diagram showing an internal configuration of the inter-gradation short circuit 133*a*.

As shown in FIG. 6, the inter-gradation short circuit 133*a* includes a level shifter LSa, a positive short-circuit switch section SWp, and a negative short-circuit switch section SWn.

The level shifter LSa generates a load signal LDa obtained by level-shifting the voltage level of the load signal LD representing a binary value (a logical level 0 or 1) to a voltage level at which each switch of the positive short-circuit switch section SWp and the negative short-circuit switch section SWn can be controlled to be turned on or off. Further, the level shifter LSa generates a load signal obtained by inverting the logic level of the load signal LDa, as a load signal LDaQ.

The positive short-circuit switch section SWp is connected to one end (a left end) of each of the wiring lines YL[1] to YL[M] that transmit the positive gradation voltages Y[1] to Y[M] in the bus wiring BS. The positive short-circuit switch section SWp includes a plurality of switch elements QP that electrically connects five ends of each of the wiring lines YL[1] to YL[M] to each other according to the load signal LDaQ. Each switch element QP is turned off in a case in which the load signal LDaQ represents a logic level 1, and is turned on in a case in which the load signal LDaQ represents a logic level 0, for example, so that the switch element electrically connects the adjacent wiring lines YL[1] to YL[M] to each other.

The negative short-circuit switch section SWn is connected to one end (a left end) of each of the wiring lines XL[1] to XL[M] that transmit the negative gradation voltages X[1] to X[M] in the bus wiring BS. The negative short-circuit switch section SWn includes a plurality of switch elements QN that electrically connects five ends of each of the wiring lines XL[1] to XL[M] to each other according to the load signal LDa. Each switch element QN is turned off in a case in which the load signal LDa represents a logic level 0, and is turned on in a case in which the load signal LDa represents a logic level 1, for example, so that the switch element electrically connects the adjacent wiring lines XL[1] to XL[M] to each other.

Figure 7:
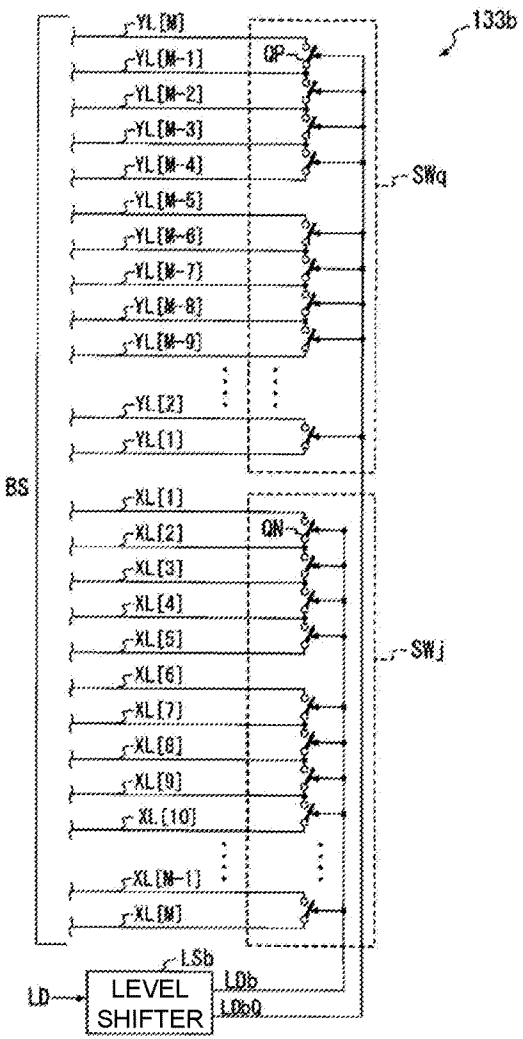
FIG. 7 is a circuit diagram showing an inter-gradation short circuit 133*b*.

FIG. 7 is a circuit diagram showing an internal configuration of the inter-gradation short circuit 133*b*.

As shown in FIG. 7, the inter-gradation short circuit 133*b* includes a level shifter LSb, a positive short-circuit switch section SWq, and a negative short-circuit switch section SWj.

Further, the level shifter LSb has the same configuration as the level shifter LSa shown in FIG. 6. Further, the positive short-circuit switch section SWq has the same configuration as the positive short-circuit switch section SWp shown in FIG. 6, and the negative short-circuit switch section SWj has the same configuration as the negative short-circuit switch section SWn shown in FIG. 6.

Therefore, the description of the operation of the level shifter LSb, the operation of the positive short-circuit switch section SWq according to a load signal LDbQ, and the operation of the negative short-circuit switch section SWj according to a load signal LDb will be omitted.

Here, the source driver 13 is provided with the inter-gradation short circuits 133*a* and 133*b*, so that in the decoder E disposed at a position where the wiring length of the bus wiring BS from the gradation voltage generation circuit 132 is long, the delay time in the decoder is significantly shortened as compared with in the decoder E disposed at a position where the wiring length is short.

Below, regarding the high-speed operation of the decoder by the inter-gradation short circuits 133*a* and 133*b*, for example, the decoders E1 and En having the longest wiring length from the gradation voltage generation circuit 132, and the decoders Er and Er+1 having the shortest wiring length will be described with reference to FIGS. 8 and 9.

Figure 8:
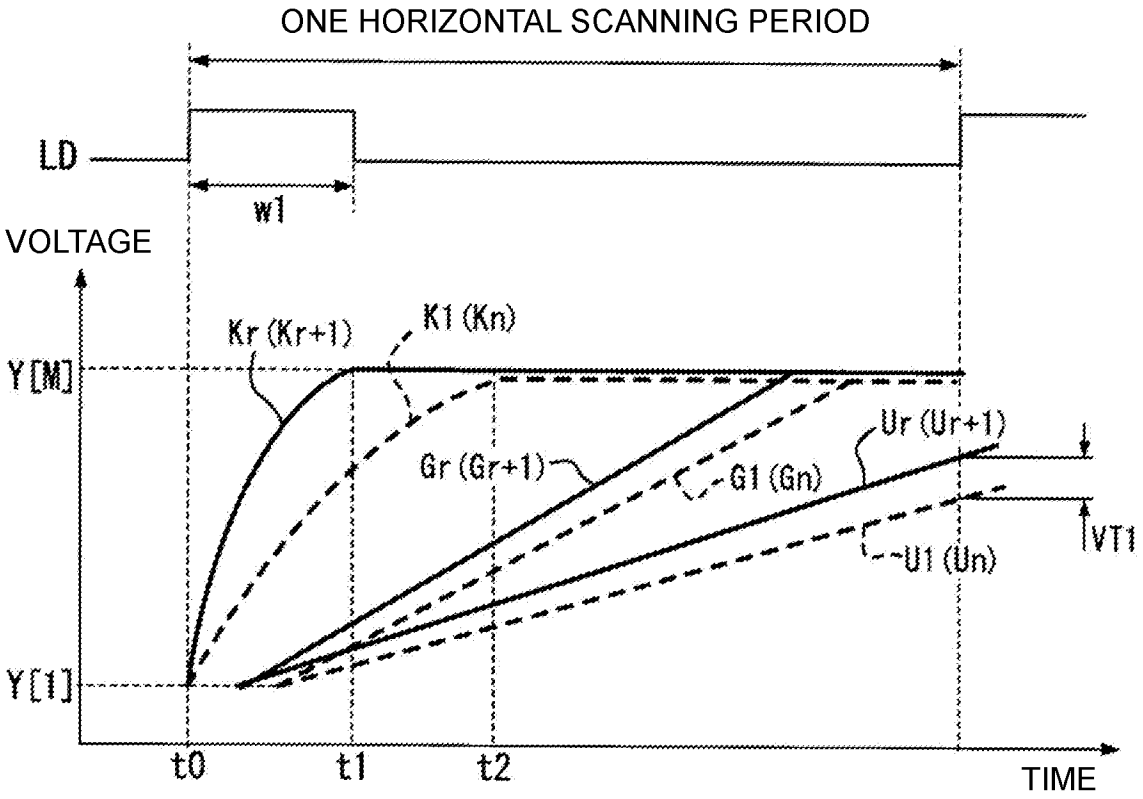
FIG. 8 is a waveform diagram showing a waveform of each signal within one horizontal scanning period in a case in which an inter-gradation short circuit is not provided.
Figure 9:
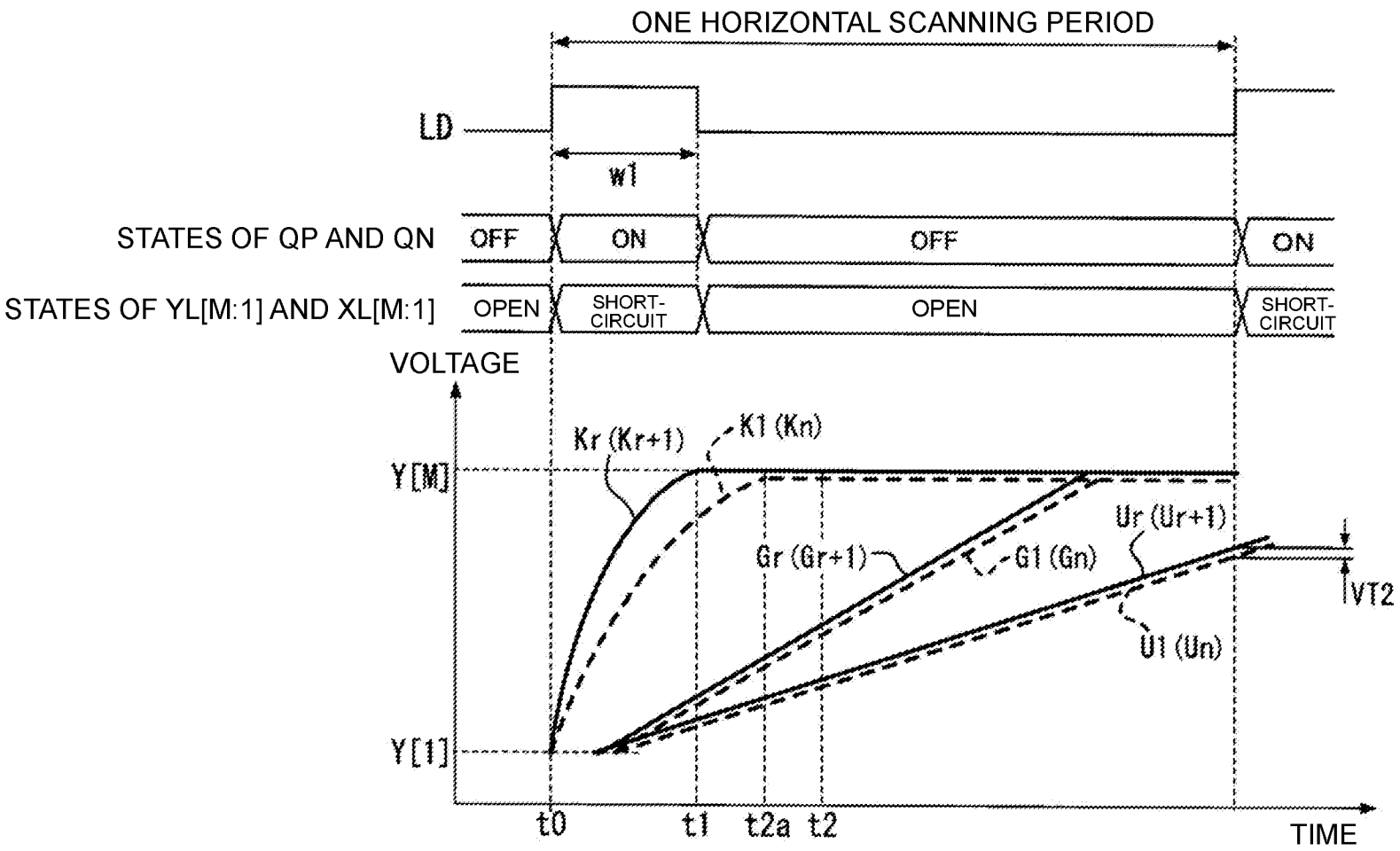
FIG. 9 is a waveform diagram showing a waveform of each signal within one horizontal scanning period in a case in which an inter-gradation short circuit is provided.

FIGS. 8 and 9 are waveform diagrams which show waveforms of each signal concerning the decoders E1, Er, Er+1, and En within one horizontal scanning period, which are generated when the decoders E1, Er, Er+1, and En transition from a selection state of the minimum positive gradation voltage Y[1] to a selection state of the maximum positive gradation voltage Y[M].

Further, FIG. 8 shows the signal waveforms generated in a case in which the inter-gradation short circuits (133*a* and 133*b*) are not provided, and FIG. 9 shows the signal waveforms generated in a case in which the inter-gradation short circuits are provided.

First, in a case in which the inter-gradation short circuits are not provided, as shown in FIG. 8, the gradation signals K1 and Kn output from the decoders E1 and En are gently changed from a state of the gradation voltage Y[1] to a state of the gradation voltage Y[M] as compared with the gradation signals Kr and the gradation signals Kr and Kr+1 output from the decoders Er and Er+1.

That is, as shown in FIG. 8, the gradation signals K1, Kr, Kr+1, and Kn start to increase from the time point t0 in the state of the gradation voltage Y[1], and at the subsequent time point t1, first, the gradation signals Kr and Kr+1 reach the state of the gradation voltage Y[M]. Then, at the time point t2 delayed from the time point t1, the gradation signals K1 and Kn reach the state of the gradation voltage Y[M].

At this time, the output amplifiers Ar and Ar+1 that have received the gradation signals Kr and Kr+1 generate the pixel drive signals Gr and Gr+1 that increase as shown in FIG. 8 as the voltages of the gradation signals Kr and Kr+1 increase. The output amplifiers Ar and Ar+1 apply these pixel drive signals Gr and Gr+1 to the source lines Dr and Dr+1 of the display panel 20 via output terminals Tr and Tr+1, respectively. The voltages of the source lines Dr and Dr+1 (hereinafter referred to as voltages Ur and Ur+1) also increase according to the pixel drive signals Gr and Gr+1. However, due to the influence of the wiring resistance and parasitic capacitance of the source lines Dr and Dr+1, the rate of voltage increase is delayed with respect to the pixel drive signals Gr and Gr+1.

Here, the output amplifiers A1 and An that have received the gradation signals K1 and Kn that increase more gently than the gradation signals Kr and Kr+1 generate the pixel drive signals G1 and Gn that increase more gently than the pixel drive signals Gr and Gr+1. The output amplifiers A1 and An apply these pixel drive signals G1 and Gn to the source lines D1 and Dn of the display panel 20 via output terminals T1 and Tn, respectively. The voltages of the source lines D1 and Dn (hereinafter referred to as voltages U1 and Un) also increase according to the pixel drive signals G1 and Gn. However, due to the influence of the wiring resistance and parasitic capacitance of the source lines D1 and Dn, the rate of voltage increase is delayed with respect to the pixel drive signals G1 and Gn.

Therefore, at the end of one horizontal scanning period, a voltage difference VT1 shown in FIG. 8 occurs between the voltages Ur and Ur+1 of the source lines Dr and Dr+1 which are responsible for displaying a screen center region of the display panel 20 and the voltages U1 and Un of the source lines D1 and Dn which are responsible for displaying screen left and right end regions of the display panel. At this time, since the state of the gradation voltages at the end of one horizontal scanning period is visually recognized as a final display image, in a case in which the voltage difference VT1 is one gradation or more, color unevenness occurs between the screen center region and the screen left and right end regions of the display panel 20.

On the other hand, in a case in which the inter-gradation short circuit is provided, as shown in FIG. 9, all the switch elements QP and QN shown in FIGS. 6 and 7, which are included in the inter-gradation short circuit, are turned on according to the load signal LD of the logic level 1 during the predetermined period w1 in the beginning of the horizontal scanning period. Further, in a period other than the predetermined period w1, all the switch elements QP and QN shown in FIGS. 6 and 7 are turned off according to the load signal LD of the logic level 0. Therefore, five wiring lines YL[M:1] and five wiring lines XL[M:1] included in the bus wiring BS are short-circuited during the predetermined period w1 in the beginning of the horizontal scanning period, and in the period other than the predetermined period w1, each wiring line is in an open state.

Accordingly, for every five wiring lines YL (XL) short-circuited by the switch elements QP (QN), electric charges corresponding to the gradation voltages Y (X) applied to the respective wiring lines YL (XL) are synthesized via the switch elements QP (QN).

At this time, the electric charges which are synthesized via the switch elements QP (QN) for every five wiring lines YL (XL) flow into the decoders E1 to En via the respective wiring lines YL (XL). During this time, each of the decoders E1 to En is in a state in which one of the 2M gradation voltages received via the respective wiring lines YL (XL) is selected according to the pixel data P supplied to each decoder. That is, each of the decoders E1 to En is in a state in which one wiring line of the 2M wiring lines (YL, XL) is connected to the non-inverting input terminal (+) of the output amplifier A.

Therefore, during the predetermined period w1 shown in FIG. 8, each of the decoders E1 to En supplies the synthesized electric charges obtained by synthesizing the electric charges on a total of five wiring lines in a short-circuited state with respect to the selected wiring line, to the non-inverting input terminal (+) of the output amplifier A via the selected wiring line. By supplement of the synthesized electric charges in this way, the input capacitance of the output amplifier A is charged and discharged. Therefore, as compared with a case in which the input capacitance of the output amplifier A is charged and discharged only with the electric charges on one wiring line, the rising or falling speeds of the gradation signals K1 to Kn and the pixel drive signals G1 to Gn are increased, and the delay times of the gradation signals K1 to Kn and the pixel drive signals G1 to Gn are shortened.

Incidentally, as shown in FIG. 3, the supplement of the synthesized electric charges from the five wiring lines is performed from the inter-gradation short circuit 133*a* (133*b*) provided at both ends of the bus wiring BS toward the intermediate portion el of the bus wiring BS. At this time, the longer the wiring length of the bus wiring BS (including YL and XL) from the inter-gradation short circuit 133*a* (133*b*) to each of the decoders E1 to En, the larger the loss of the synthesized electric charges due to the wiring resistance. That is, the amount of the synthesized electric charges which are supplemented to the decoder E1 (En) having a short wiring length from the inter-gradation short circuit 133*a* (133*b*) is more than the amount of the synthesized electric charges which are supplemented to the decoder Er (Er+1) having a long wiring length therefrom.

Accordingly, as shown in FIG. 9, the gradation signal Kr (Kr+1) output from the decoder Er (Er+1) having the longest wiring length from the inter-gradation short circuit 133*a* (133*b*) rises at substantially the same speed as in the case shown in FIG. 8, and reaches the gradation voltage Y[M] immediately after the time point t1. On the other hand, the gradation signal K1 (Kn) output from the decoder E1 (En) having the shortest wiring length rises at a higher speed than in the case shown in FIG. 8, and reaches the gradation voltage Y[M] at the time point t2*a* earlier than the time point t2.

That is, by short-circuiting the adjacent wiring lines at both ends of the bus wiring BS, a difference between the delay time occurring in the gradation signal K1 (Kn) and the delay time occurring in the gradation signal Kr (Kr+1) is shortened. In short, by shortening the delay time of the decoder (for example, E1, En) disposed at the position where the wiring length of the bus wiring BS from the gradation voltage generation circuit 132 is long, the difference between the delay time of the decoder (for example, E1, En) and the delay time of the decoder (for example, Er, Er+1) disposed at the position where the wiring length is short is reduced.

Therefore, as shown in FIG. 9, at the end of one horizontal scanning period, a voltage difference VT2 between the voltage Ur (Ur+1) of the source line Dr (Dr+1) which is responsible for displaying the screen center region and the voltage U1 (Un) of the source line D1 (Dn) which is responsible for displaying the screen left end (right end) region is smaller than the voltage difference VT1 shown in FIG. 8. That is, it is possible to make the voltage difference VT2 smaller than the voltage difference of one gradation.

Therefore, according to the source driver 13 shown in FIG. 3, in driving the high-definition and large-screen display panel 20, it is possible to provide a high-quality display image in which color unevenness that occurs between the screen center region and the screen left and right end regions of the display panel 20 is suppressed.

Further, in the above-described embodiment, as shown in FIGS. 6 and 7, the inter-gradation short circuits 133*a* and 133*b* are constituted by a plurality of switch elements QP and QN, but these switch elements QP and QN may be realized as MOS type transistors.

That is, all the switch elements QP included in the positive short-circuit switch sections SWp and SWq shown in FIGS. 6 and 7 are realized as p-channel type MOS transistors, and all the switch elements QN included in the negative short-circuit switch sections SWn and SWj shown in FIGS. 6 and 7 are realized as n-channel type MOS transistors.

Here, the level shifter LSa shown in FIG. 6 supplies the load signal LDa to a gate of each of the n-channel type MOS transistors as the switch elements QN included in the negative short-circuit switch section SWn. Further, the level shifter LSa supplies the load signal LDaQ obtained by inverting the logical level of the load signal LDa to the gate of each of the p-channel MOS transistors as the switch elements QP included in the positive short-circuit switch section SWp. On the other hand, the level shifter LSb shown in FIG. 7 supplies the load signal LDb to a gate of each of the n-channel type MOS transistors as the switch elements QN included in the negative short-circuit switch section SW1. Further, the level shifter LSb supplies the load signal LDbQ obtained by inverting the logical level of the load signal LDb to the gate of each of the p-channel MOS transistors as the switch elements QP included in the positive short-circuit switch section SWq.

Further, the p-channel type MOS transistor as the switch element QP shown in FIGS. 6 and 7 has a drain and a source which are connected to one line and the other line of a pair of wiring lines adjacent to each other, respectively. Similarly, the n-channel type MOS transistor as the switch element QN also has a drain and a source which are connected to one line and the other line of a pair of wiring lines adjacent to each other, respectively.

Further, in the examples shown in FIGS. 6 and 7, each of the inter-gradation short circuits 133*a* and 133*b* has a configuration in which for every five gradations, five wiring lines (YL, XL) for transmitting the gradation voltages for the five gradations are short-circuited in the beginning of each horizontal scanning period. However, the number of short-circuited wiring lines is not limited to five. That is, the number of short-circuited wiring lines only has to be the number that allows the difference between the voltage increased by the supplement of the synthesized electric charges synthesized through each wiring line due to the short circuit and the voltage after the end of the short circuit to be small, for example, four to eight for every four to eight wiring lines corresponding to four to eight gradations adjacent to each other.

In short, the source driver 13 only has to include bus wiring, a gradation voltage generation circuit, a plurality of decoders, a plurality of output amplifiers, and first and second inter-gradation short circuits as described below.

The bus wiring (BS) is constituted by a plurality of wiring lines (YL[1] to YL[M], XL[1] to XL[M]) extending in a predetermined direction (dL). The gradation voltage generation circuit (132) generates M gradation voltages (Y[1] to Y[M], X[1] to X[M]) which represent the brightness levels with M gradations (M is an integer of 2 or more). Then, the gradation voltage generation circuit (132) applies the M gradation voltages to an intermediate portion (el) between one end and the other end of each of the M wiring lines (XL or YL) belonging to the bus wiring (BS) described above, respectively. The plurality of decoders (E1 to En) is disposed side by side along M wiring lines (XL or YL), and each of the decoders receives M gradation voltages (Y or X) via these M wiring lines and selects one of the M gradation voltages according to pixel data pieces (P) to output the selected gradation voltage. The plurality of output amplifiers (A1 to An) individually amplifies voltages (K1 to Kn) output from the plurality of decoders described above and generates the amplified voltages as a plurality of pixel drive voltages (G1 to Gn). The first inter-gradation short circuit (133*a*) short-circuits one ends of each of the M wiring lines described above according to a load video signal (LD) for capturing a plurality of pixel data pieces. The second inter-gradation short circuit (133*b*) short-circuits the other ends of each of the M wiring lines described above according to the load signal (LD).

Further, in the example shown in FIG. 3, the gradation voltages Y[M:1] and X[M:1] generated by the gradation voltage generation circuit 132 are applied to an intermediate portion of the bus wiring BS of one system disposed along the decoders E1 to En disposed side by side in a row. Therefore, there is still a difference between the wiring length from the gradation voltage generation circuit 132 to the decoder E1 (En) and the wiring length from the gradation voltage generation circuit 132 to the decoder Er (Er+1). As a result, in a case in which the wiring resistance due to the bus wiring BS is relatively high, a large time difference occurs between the delay time occurring in the gradation signal K1 (Kn) and the delay time occurring in the gradation signal Kr (Kr+1) and there is a possibility that the above-mentioned color unevenness cannot be reliably suppressed.

Therefore, the bus wiring BS of the one system may be divided into two at the intermediate portion in the direction dL, and the gradation voltages Y[M:1] and X[M:1] generated by the gradation voltage generation circuit 132 may be applied to the intermediate portions of each of the divided bus wiring, so that the delay time due to the wiring resistance can be halved.

Figure 10:
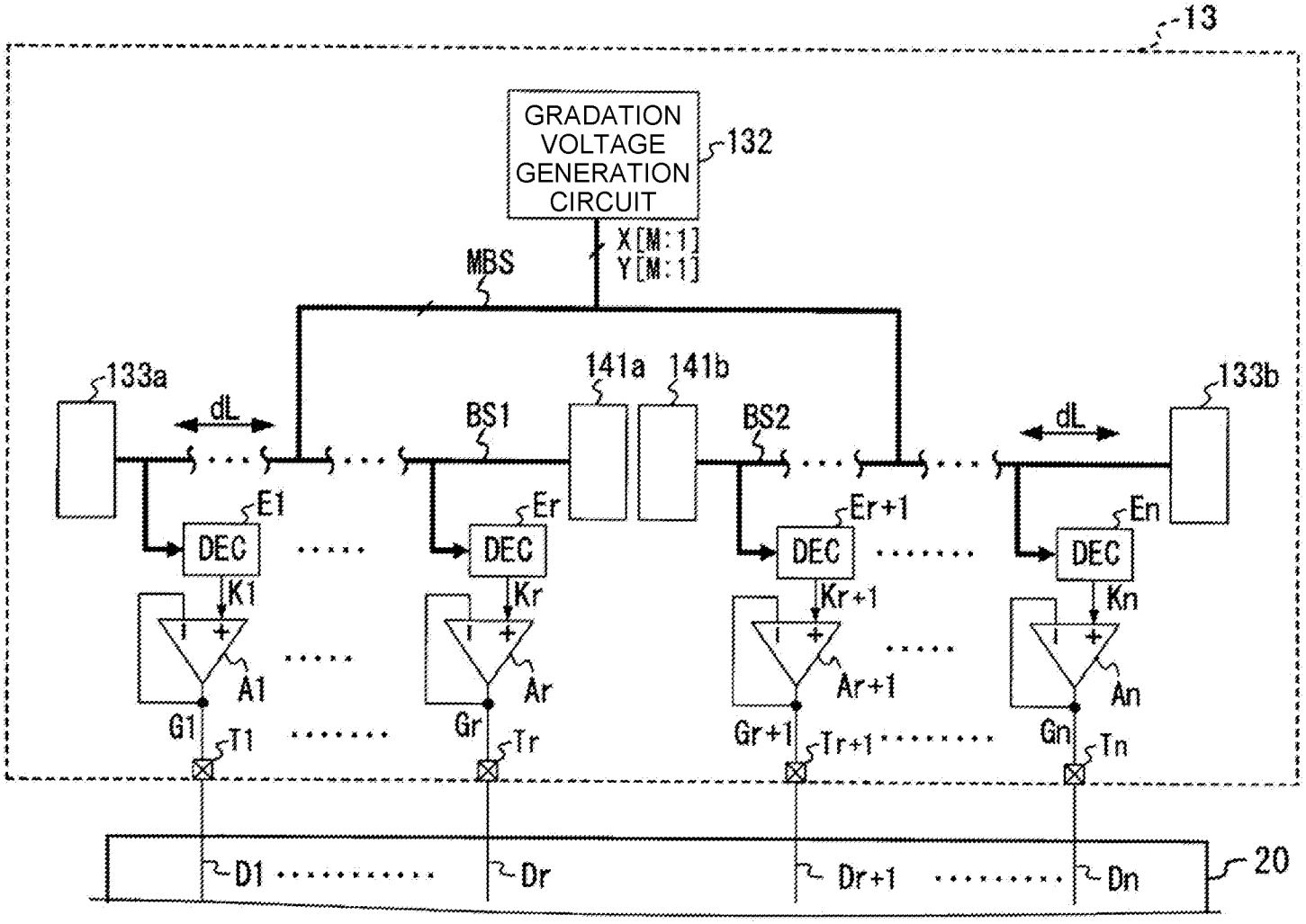
FIG. 10 is a circuit and layout diagram showing another example of the internal configuration of the source driver 13.

FIG. 10 is a diagram showing another configuration of the source driver 13, which is made in view of this point, and showing a disposition form of each block in the semiconductor chip. Further, in FIG. 10, the data latch section 131, the level shift circuits L1 to Ln, and the wiring line of the load signal LD shown in FIG. 3 are omitted. Further, the decoders E1 to En, the output amplifiers A1 to An, the gradation voltage generation circuit 132, and the inter-gradation short circuits 133*a* and 133*b* shown in FIG. 10 are the same as those shown in FIG. 3.

In the source driver 13 shown in FIG. 10, the bus wiring BS shown in FIGS. 3 and 5 is divided into first bus wiring BS1 via which the gradation voltages Y[M:1] and X[M:1] are supplied to the decoders E1 to Er, respectively, and second bus wiring BS2 via which the gradation voltages Y[M:1] and X[M:1] are supplied to the decoders Er+1 to En, respectively. Further, the bus wiring BS1 and BS2 are not connected to each other.

The inter-gradation short circuit 133*a* is connected to one end of the bus wiring BS1, and an inter-gradation short circuit 141*a* having the same configuration as the inter-gradation short circuit 133*b* shown in FIG. 7 is connected to the other end of the bus wiring BS1. An inter-gradation short circuit 141*b* having the same configuration as the inter-gradation short circuit 133*a* shown in FIG. 6 is connected to one end of the bus wiring BS2, and the inter-gradation short circuit 133*b* is connected to the other end of the bus wiring BS2.

In the configuration shown in FIG. 10, the gradation voltage generation circuit 132 applies the gradation voltages Y[M:1] and X[M:1] generated by itself to main bus wiring MBS provided separately from the bus wiring BS1 and BS2. Further, the main bus wiring MBS is constituted by 2M wiring lines for individually transmitting the gradation voltages Y[1] to Y[M] and X[1] to X[M], respectively, similar to the bus wiring BS shown in FIG. 5. Here, as shown in FIG. 10, one end of each of the 2M wiring lines in the main bus wiring MBS is connected to each wiring line belonging to the bus wiring BS1 at an intermediate portion between one end and the other end of each wiring line belonging to the first bus wiring BS1. Further, as shown in FIG. 10, the other end of each of the 2M wiring lines in the main bus wiring MBS is connected to each wiring line belonging to the bus wiring BS2 at an intermediate portion between one end and the other end of each wiring line belonging to the second bus wiring BS2.

According to the configuration shown in FIG. 10, the difference in the delay time of each of the gradation signals K1 to Kn and the difference in the delay time of each of the pixel drive signals G1 to Gn can be smaller than those in the case of employing the configuration shown in FIG. 3. Therefore, it is possible to more reliably suppress color unevenness that occurs between the screen center region and the screen left and right end regions of the display panel 20.

Further, the source driver 13 shown in FIG. 10 only has to include first and second bus wiring, a gradation voltage generation circuit, first to nth decoders (n is an integer of 2 or more), an output amplifier, and first to fourth inter-gradation short circuits as described below.

The first bus wiring (BS1) and the second bus wiring (BS2) are each constituted by a plurality of wiring lines (YL[1] to YL[M], XL[1] to XL[M]). The gradation voltage generation circuit (132) generates M gradation voltages (Y[1] to Y[M], X[1] to [X]) which represent the brightness levels with M gradations (M is an integer of 2 or more). Then, the gradation voltage generation circuit (132) applies these M gradation voltages to the intermediate portion between one end and the other end of each of the M wiring lines belonging to the first bus wiring (BS1), respectively, and applies these M gradation voltages to the intermediate portion between one end and the other end of each of the M wiring lines belonging to the second bus wiring (BS2), respectively. The first to rth decoders (E1 to Er) (r is an integer 2 or more and less than n) of the first to nth decoders are disposed side by side along the first bus wiring (BS1), and each of the decoders receives M gradation voltages via the M wiring lines belonging to the first bus wiring and selects one of the M gradation voltages according to the pixel data pieces (P) to output the selected gradation voltage. The r+1th to nth decoders (Er+1 to En) of the first to nth decoders are disposed side by side along the second bus wiring (BS2), and each of the decoders receives M gradation voltages via the M wiring lines belonging to the second bus wiring and selects one of the M gradation voltages according to the pixel data pieces (P) to output the selected gradation voltage. The output amplifiers (A1 to An) individually amplify voltages (K1 to Kn) output from the first to nth decoders and generate the amplified voltages as n pixel drive voltages (G1 to Gn).

The first inter-gradation short circuit (133*a*) short-circuits one ends of each of the M wiring lines belonging to the first bus wiring (BS1) according to a load signal (LD) for capturing a plurality of pixel data pieces. The second inter-gradation short circuit (141*a*) short-circuits the other ends of each of the M wiring lines belonging to the first bus wiring (BS1) according to the load signal (LD). The third inter-gradation short circuit (141*a*) short-circuits one ends of each of the M wiring lines belonging to the second bus wiring (BS2) according to the load signal (LD). The fourth inter-gradation short circuit (133*b*) short-circuits the other ends of each of the M wiring lines belonging to the second bus wiring (BS2) according to the load signal (LD).

What is claimed is:

1. A display driver that captures a plurality of pixel data pieces based on a video signal and according to a load signal and generates a plurality of pixel drive voltages to be applied to a plurality of source lines of a display panel according to the plurality of captured pixel data pieces, the display driver comprising:

bus wiring constituted by a plurality of wiring lines;

a gradation voltage generation circuit that generates M gradation voltages representing brightness levels with M gradations (M is an integer of 2 or more), wherein each of the wiring lines has a first end and a second end, the gradation voltage generation circuit applies the M gradation voltages to an intermediate portion between the first end and the second end of each of M wiring lines belonging to the bus wiring;

a plurality of decoders which is disposed side by side along the M wiring lines, and each of which receives the M gradation voltages via the M wiring lines and selects one of the M gradation voltages according to the pixel data pieces to output the selected gradation voltage;

a plurality of output amplifiers that individually amplifies the voltages output from the plurality of decoders and generates the amplified voltages as the plurality of pixel drive voltages;

a first inter-gradation short circuit that short-circuits the first ends of each of the M wiring lines according to the load signal; and a second inter-gradation short circuit that short-circuits the second ends of each of the M wiring lines according to the load signal, wherein, in a state in which the M wiring lines are divided into groups each constituted by a plurality of adjacent wiring lines, the first and second inter-gradation short circuits short-circuit the wiring lines belonging to the group for each group, the first and second inter-gradation short circuits short-circuit the wiring lines belonging to the group during a predetermined period in a beginning for each horizontal scanning period of the video signal.

2. The display driver according to claim 1, wherein a number of the wiring lines belonging to the group is 4 to 8.

3. The display driver according to claim 1, wherein the bus wiring is constituted by 2M wiring lines, and wherein the gradation voltage generation circuit generates M positive gradation voltages and M negative gradation voltages each representing brightness levels with M gradations, and applies each of M positive gradation voltages and M negative gradation voltages to the intermediate portion on the 2M wiring lines.

4. The display driver according to claim 3, wherein the first and second inter-gradation short circuits each include a plurality of first switch elements that short-circuits the M wiring lines, of the 2M wiring lines, to which the M positive gradation voltages are applied according to the load signal for each group, and a plurality of second switch elements that short-circuits the M wiring lines, of the 2M wiring lines, to which the M negative gradation voltages are applied according to the load signal for each group.

5. The display driver according to claim 4, wherein the first switch element is a p-channel type MOS transistor in which a drain is connected to one of a pair of wiring lines adjacent to each other and a source is connected to another thereof, and wherein the second switch element is an n-channel type MOS transistor in which a drain is connected to one of a pair of wiring lines adjacent to each other and a source is connected to another thereof.

6. A display driver that captures a plurality of pixel data pieces based on a video signal and according to a load signal and generates a plurality of pixel drive voltages to be applied to a plurality of source lines of a display panel according to the plurality of captured pixel data pieces, the display driver comprising:

first and second bus wiring each constituted by a plurality of wiring lines;

a gradation voltage generation circuit that generates M gradation voltages representing brightness levels with M gradations (M is an integer of 2 or more), wherein each of the wiring lines belonging to the first bus wiring has a first end and a second end, the gradation voltage generation circuit applies the M gradation voltages to an intermediate portion between the first end and the second end of each of M wiring lines belonging to the first bus wiring, and wherein each of the wiring lines belonging to the second bus wiring has a third end and a fourth end, the gradation voltage generation circuit applies the M gradation voltages to an intermediate portion between the third end and the fourth end of each of M wiring lines belonging to the second bus wiring;

first to rth decoders (r is an integer of 2 or more) which are disposed side by side along the first bus wiring, and each of which receives the M gradation voltages via the M wiring lines belonging to the first bus wiring and selects one of the M gradation voltages according to the pixel data pieces to output the selected gradation voltage;

(r+1)th to nth decoders which are disposed side by side along the second bus wiring, and each of which receives the M gradation voltages via the M wiring lines belonging to the second bus wiring and selects one of the M gradation voltages according to the pixel data pieces to output the selected gradation voltage;

output amplifiers that individually amplify the voltages output from the first to rth decoders and the (r+1)th to nth decoders and generate the amplified voltages as n pixel drive voltages, n is an integer of 4 or more;

a first inter-gradation short circuit that short-circuits the first ends of each of the M wiring lines belonging to the first bus wiring according to the load signal;

a second inter-gradation short circuit that short-circuits the second ends of each of the M wiring lines belonging to the first bus wiring according to the load signal;

a third inter-gradation short circuit that short-circuits the third ends of each of the M wiring lines belonging to the second bus wiring according to the load signal; and a fourth inter-gradation short circuit that short-circuits the fourth ends of each of the M wiring lines belonging to the second bus wiring according to the load signal, wherein, in a state in which the M wiring lines are divided into groups each constituted by a plurality of adjacent wiring lines, the first to fourth inter-gradation short circuits short-circuit the wiring lines belonging to the group for each group, the first to fourth inter-gradation short circuits short-circuit the wiring lines belonging to the group during a predetermined period in a beginning for each horizontal scanning period of the video signal.

7. A display driver that captures a plurality of pixel data pieces based on a video signal and according to a load signal and generates a plurality of pixel drive voltages to be applied to a plurality of source lines of a display panel according to the plurality of captured pixel data pieces, the display driver comprising:

bus wiring constituted by M wiring lines (M is an integer of 2 or more);

a gradation voltage generation circuit that generates M gradation voltages representing brightness levels with gradations, wherein each of the wiring lines has a first end and a second end, the gradation voltage generation circuit applies the M gradation voltages to a portion between the first end and the second end of each of the M wiring lines;

a plurality of decoders which is disposed side by side along the M wiring lines, and each of which receives the M gradation voltages via the M wiring lines and selects one of the M gradation voltages according to the pixel data pieces to output the selected gradation voltage;

a plurality of output amplifiers that individually amplifies the voltages output from the plurality of decoders and generates the amplified voltages as the plurality of pixel drive voltages; and an inter-gradation short circuit that short-circuits at least one of the first ends and the second ends of each of the M wiring lines according to the load signal, wherein, in a state in which the M wiring lines are divided into groups each constituted by a plurality of adjacent wiring lines, the inter-gradation short circuit short-circuits the wiring lines belonging to the group for each group, the inter-gradation short circuit short-circuits the wiring lines belonging to the group during a predetermined period in a beginning for each horizontal scanning period of the video signal.

* * * * *